US006663719B2

(12) United States Patent
Shinozaki et al.

(10) Patent No.: US 6,663,719 B2
(45) Date of Patent: Dec. 16, 2003

(54) CLEANING SYSTEM AND A METHOD OF CLEANING

(75) Inventors: Kenichi Shinozaki, Isehara (JP); Tohru Maruyama, Fujisawa (JP)

(73) Assignee: Ricoh Company, Ltd., Tokyo (JP)

( * ) Notice: Subject to any disclaimer, the term of this patent is extended or adjusted under 35 U.S.C. 154(b) by 112 days.

(21) Appl. No.: 09/816,379

(22) Filed: Mar. 26, 2001

(65) Prior Publication Data

US 2001/0035195 A1 Nov. 1, 2001

(30) Foreign Application Priority Data

Mar. 24, 2000 (JP) ..... P2000-083638

(51) Int. Cl.[7] ..... B08B 7/02

(52) U.S. Cl. ..... 134/1; 134/6; 134/7; 134/8; 134/9; 134/10; 134/27.1; 15/256; 399/343; 399/345

(58) Field of Search ..... 134/1, 6, 7, 8, 134/9, 10, 27.1; 15/256.52; 399/343, 345

(56) References Cited

U.S. PATENT DOCUMENTS 4,080,059 A * 3/1978 Tani formerly Nishikawa et al. ..... 399/348
4,392,742 A * 7/1983 Landa ..... 399/348
4,402,103 A * 9/1983 Yanagawa et al. ..... 15/256.52
4,684,242 A * 8/1987 Schultz ..... 399/343
5,612,775 A * 3/1997 Nagaoka ..... 399/345
6,171,742 B1 * 1/2001 Kawada et al. ..... 430/67
6,302,669 B1 * 10/2001 Nishizawa et al. ..... 425/3
6,398,345 B1 * 6/2002 Sakai et al. ..... 347/55

* cited by examiner

*Primary Examiner*—Randy Gulakowski
*Assistant Examiner*—Gentle E. Winter
(74) *Attorney, Agent, or Firm*—Oblon, Spivak, McClelland, Maier & Neustadt, P.C.

(57) ABSTRACT

A cleaning system and a cleaning method is provided with a cleaning medium comprising a magnetic substance and a magnetic field generating device for applying a magnetic force to the magnetic substance in the cleaning medium so that the magnetic substance and the area to be cleaned are rubbed together. The area to be cleaned is cleaned by the rubbing action of the cleaning medium. The interior of the cleaned object not reachable by hands or instruments can be easily cleaned with this device. The cleaning medium, made of a magnetic substance, is guided into the interior of the cleaned object. The magnetic field generating device generates a magnetic field in the cleaning medium and thereby applies a force to the magnetic substance. By rubbing the magnetic substance on the inner wall surface of the area to be clean, the object can be cleaned efficiently.

14 Claims, 13 Drawing Sheets

CLEANING SYSTEM AND A METHOD OF CLEANING

CROSS REFERENCE TO RELATED APPLICATIONS

This application claims benefit of priority under 35 U.S.C. 120 to Japanese Patent Application No. 2000-083638 filed in the Japanese Patent Office on Mar. 24, 2000, the entire contents of which are incorporated herein by reference.

BACKGROUND OF THE INVENTION

1. Field of the Invention

The present invention relates to cleaning systems and a methods of cleaning.

2. Discussion of the Background

According to the background art, when the interior of a molded object has to be cleaned, the object to be cleaned is dipped in a cleaning liquid and rubbed by a brush or sponge, etc. in order to remove the dirt attached thereto.

However, according to the above background art, it is difficult to clean molded objects of complicated shape. Furthermore, it is difficult to clean the "blind alley" structure made by ultrasonic welding and the interiors of assembled objects, etc., because the fingers of an operator cannot reach within the objects. For this reason, it is necessary to disassemble the object to enable it to be cleaned or to dip the object in a cleaning liquid and thereby cause the dirt to float out completely, which may take a long time. These are some of the problems with the background art.

SUMMARY OF THE INVENTION

The present invention has been made in view of the above-discussed problems and other problems, and has solved the above-mentioned defects and problems of the background art.

Stated in more detail, the present invention aims at providing improved cleaning systems and cleaning methods. The present invention further aims at enabling the interior of an object to be cleaned when it is not reachable by an operator's hands or by an instrument. The present invention still further aims at enabling easy cleaning of an object even though there exists convex or concave portions on the area of the object to be cleaned and at enabling an easy adjustment of the cleaning power. The invention still further aims at effectively cleaning the area of the object to be cleaned and at allowing a large margin for adjusting cleaning characteristics.

Other objects of the invention are: reducing the cost of the cleaning operation, effectively performing the rubbing/cleaning operation, effectively cleaning even narrow areas having concave or convex portions, causing the dirt to be easily stripped off, thereby effectively performing the cleaning operation, performing successive cleaning on a wide area, and preventing residual dirt from remaining after cleaning.

Still other objects of the invention are: enabling performing successive cleaning operations in a limited area and eliminating residual dirt after cleaning, reducing the impact cleaning has on the environment, enabling the performing of cleaning in a short time, and effectively removing residual dirt remaining on the object after cleaning.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
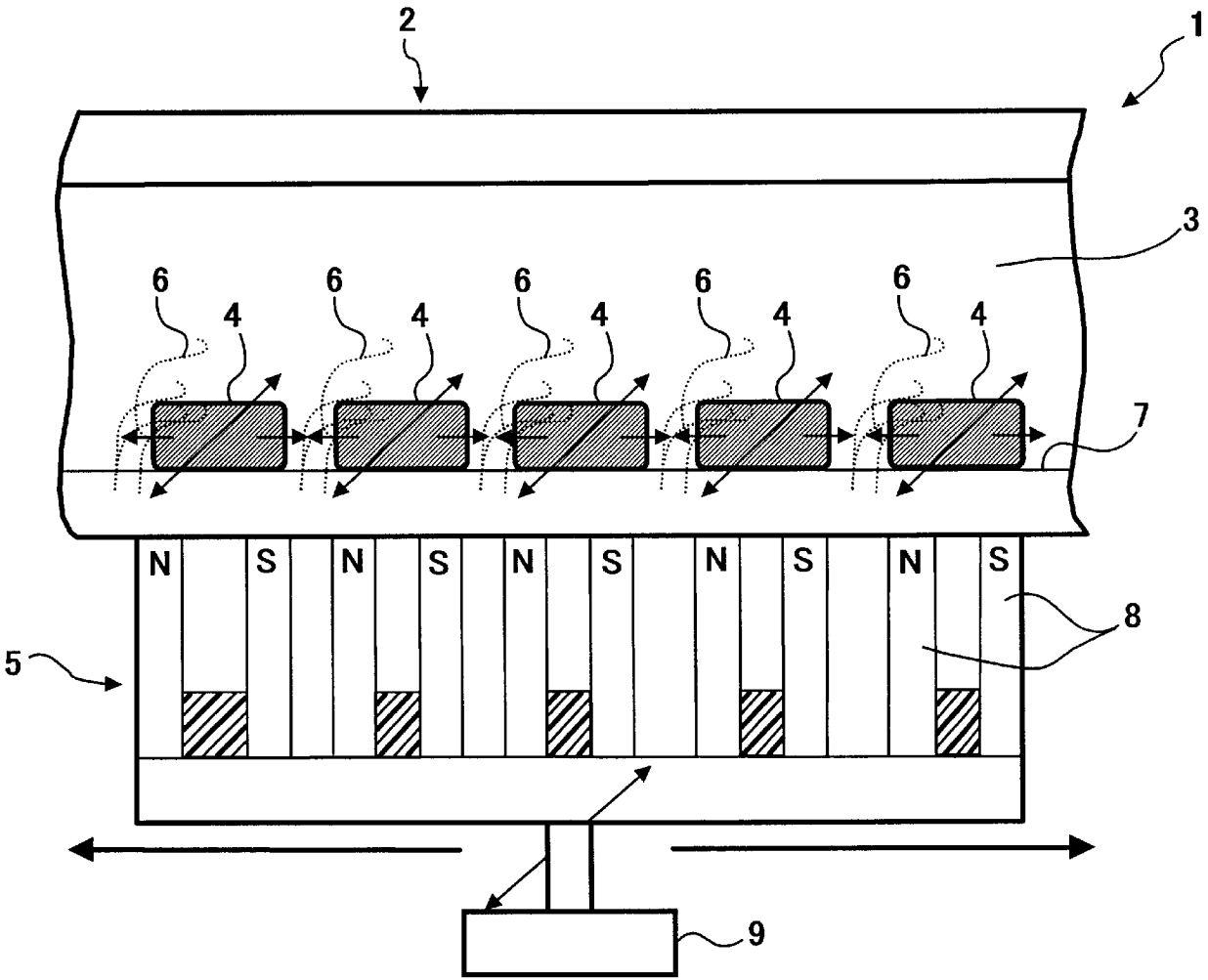
FIG. 1 is a concept diagram illustrating an outline of the cleaning system according to a first embodiment of the present invention.

In describing the preferred embodiment of the present invention illustrated in the accompanying drawings, specific terminology is employed for the sake of clarity. However, the present invention is not intended to be limited to the specific terminology so selected and it is to be understood that each specific element includes all technical equivalents which operate in a similar manner.

Referring now to the accompanying drawings; wherein like reference numerals designate identical or corresponding parts throughout the several views or diagrams, and more particularly to FIGS. 1 through 13, there are illustrated cleaning systems, and methods of cleaning according to the present invention.

In order to attain the aforementioned objects of the present invention, a first aspect of the invention is a cleaning system for cleaning an area to be cleaned provided with: a cleaning medium having a part thereof composed of a magnetic substance guided onto the area to be cleaned; and a magnetic field generating device for applying a magnetic force to the magnetic substance by the action of a magnetic field generated in the cleaning medium and rubbing together the magnetic substance and the position to be cleaned, in which the cleaning position is cleaned by the rubbing operation of the cleaning medium.

Consequently, even the interior of the cleaned object, hardly reachable by hands or an instrument, can be easily cleaned with this simple device.

The second aspect of the invention is a cleaning system in connection with the first aspect, in which at least a part of the magnetic substance is a magnetic fluid. Consequently, even though there exist concave and convex portions on the area to be cleaned, the cleaned object can be easily cleaned by the shearing force (stress) due to the flowing of the magnetic fluid, and the cleaning force can be easily adjusted with the intensity of the magnetic field.

The third aspect of the invention is a cleaning system in connection with the first or second aspect, in which at least a part of the magnetic substance is a magnetic fluid. Consequently, the area to be cleaned is strongly rubbed with the polishing agent and thereby the cleaning operation can be done effectively. Furthermore, by changing the composition ratio with the polishing agent, the freedom of adjusting cleaning properties can be enlarged.

The fourth aspect of the invention is a cleaning system in connection with one of the first through third aspects, in which the magnetic substance is enclosed in an elastic covering material. Consequently, the magnetic material as the cleaning medium does not become dirty by the cleaning operation. Thereby, the cleaning medium can be repeatedly used and the cost of the cleaning operation can be reduced.

The fifth aspect of the invention is a cleaning system in connection with one of the first through fourth aspects, in which the particle shape of at least a part of the magnetic substance is polygonal. Consequently, the rubbingly-cleaning operation can be done effectively compared with the case of the non-polygonal shape such as the sphere shape.

The sixth aspect of the invention is a cleaning system in connection with one of the first through fifth aspects, in which the respective intensities of the magnetic substances and the polishing agent are different. Consequently, the comparatively small particle can enter in the concave and convex narrow areas and clean the object to be cleaned, and thereby the cleaning operation can be done effectively.

The seventh aspect of the invention in connection with one of the first through sixth aspects, in which the cleaning system further includes a magnetic field changing device for successively changing at least either one of the intensity and the direction of the magnetic field. Consequently, by changing the intensity and the direction of the magnetic field, the dirt can be easily stripped off and thereby the cleaning operation can be effectively done.

The eighth aspect of the invention is a cleaning system in connection with the seventh aspect, in which the magnetic field changing device generates a successive flow of the cleaning medium to be directed in one direction by successively changing at least one of said intensity and direction of said magnetic field. In such a structure, the successive cleaning operation can be done over a wide area. After cleaning the dirt is carried away and residual dirt can be prevented from remaining on the object to be cleaned.

The ninth aspect of the invention in connection with the eighth aspect, in which the magnetic field changing device generates a rotative magnetic field and thereby generates successive flow for directing the cleaning medium in one direction. In such a structure, successive cleaning operations can be done in a limited area.

The tenth aspect of the invention in connection with the seventh aspect is cleaning system, in which the magnetic field changing device changes the magnetic field to an alternate magnetic field. In such a structure, the direction of the magnetic field is turned over successively and the dirt can be easily stripped off. Thereby, the cleaning operation can be easily done.

The eleventh aspect of the invention in connection with one of the first through tenth aspects is a cleaning system in which the cleaning system further includes: a dirt removing device, in which, by controlling the magnetic field generating device, the magnetic field having the intensity to the extent that the dirt removed from the cleaned object by the operation of the cleaning is caused to float up on the upper surface of the cleaning medium. In such the structure, since the dirt after cleaning can be easily removed, the cleaning medium can be repeatedly used. Thereby, the cleaning cost can be reduced and the stress on the environment can be also reduced.

The twelfth aspect of the invention in connection with one of the first through sixth aspects is a cleaning system, in which the cleaning system further includes: a magnetic field mode changing device for changing in order the magnetic field mode exerted on the same position of the cleaned object by the magnetic field generating device to the plural sorts of mode. In such a structure, various sorts of force can be exerted on the magnetic material. Thereby, the cleaning operation can be done effectively.

The thirteenth aspect of the invention in connection with one of the seventh through eleventh aspects is the cleaning system, in which the cleaning system further comprises a rubbing material; in which, when at least one of the intensity and the direction of said magnetic field is successively changed by the magnetic field changing device, the magnetic force applied to the magnetic pole of the magnetic field generating device is utilized as a drive source; and in which, by the utilization of the drive source, the position excluding the position of the cleaned object is rubbingly cleaned by the rubbing material. In such a structure, the other position excluding the area to be cleaned by use of the cleaning medium can be jointly cleaned and the cleaning operation for the cleaned object can be performed in a short time.

The fourteenth aspect of the invention in connection with one of the first through thirteenth aspects is the cleaning system, in which the cleaning system further includes: a flushing device for flushing the cleaned object after the cleaning operation and removing the remaining dirt even after the cleaning operation. In such the structure, the residual dirt stripped off from the cleaned object after cleaning can be removed effectively.

The fifteenth aspect of the invention is a method of cleaning the object to be cleaned by use of a cleaning system including the steps of: generating a magnetic field in a cleaning medium having a part thereof composed of magnetic substance and guided onto the area to be cleaned of the cleaned object; applying a magnetic force to the magnetic substance by the action of the generated magnetic field; and rubbing together the magnetic substance and the area to be cleaned in order to clean the cleaning position with the cleaning medium. In such a method, even the interior of the cleaned object hardly reachable by hands or an instrument can be easily cleaned with the simple device.

The sixteenth aspect of the invention in connection with the fifteenth aspect is the method of cleaning the object to be cleaned, in which at least a part of the magnetic substance is a magnetic fluid. In such a method, even though there exist concave and convex portion on the area to be cleaned, the cleaned object can be easily cleaned by the shearing force (stress) due to the flow of the magnetic fluid, and the adjustment of the cleaning force can be done varying the intensity of the magnetic field.

The seventeenth aspect of the invention in connection with the fourteenth or fifteenth aspect is the method of cleaning the object to be cleaned, in which a polishing agent contained in the cleaning medium in order to further effectively clean the cleaning position by the action of the magnetic force from the magnetic substance is employed. In such a method, the area to be cleaned is strongly rubbed with the polishing agent and thereby the cleaning operation can be done effectively. Furthermore, by changing the composition ratio of the polishing agent, freedom of adjusting the cleaning properties is made possible.

The eighteen aspect of the invention in connection with one of the fourteenth through seventeenth aspects is a method of cleaning the object to be cleaned, in which the magnetic substance enclosed in an elastic covering material is employed. In such the method, since the magnetic material as the cleaning medium does not become dirty by the cleaning operation, the medium can be repeatedly used and the cost of the cleaning works can be reduced.

The nineteenth aspect of the invention in connection with one of the fifteenth through eighteenth, a method of cleaning the object to be cleaned, in which the particle shape of at least a part of the magnetic substance is polygonal. In such the method, the cleaning can be done more effectively, compared with the case of the non-polygonal shape such as sphere shape.

The twentieth aspect of the invention in connection with one of the fifteenth through nineteenth aspects is the method of cleaning the object to be cleaned, in which the respective sizes of the magnetic substance and the polishing agent are of at least two sorts. In such a method, the comparatively small particles can enter the narrow concave and convex area and sufficiently clean the object.

The twenty-first aspect of the invention in connection with one of the fifteenth through twentieth aspects is a method of cleaning the object to be cleaned, in which the cleaning operation is performed by successively changing at least either one of the intensity and the direction of the magnetic field. In such the method, the dirt can be easily stripped off by successively changing at least one of the intensity and the direction of the magnetic field. Thereby, the cleaning operation can be done effectively.

In the twenty-second aspect of the invention in connection with the twentieth aspect is a method of cleansing the object to be cleaned, in which the successive flow of the cleaning medium to be directed in one direction is generated by successively changing at least one of the intensity and direction of the magnetic field. In such a method, the successive cleaning operation can be done over the wide area. The dirt removed is carried away, and thereby the dirt on the cleaned object can be prevented from remaining thereon.

The twenty-third aspect of the invention in connection with the twenty-second aspect is the method of cleaning the object to be cleaned as defined in claim 22, wherein a rotative magnetic field is generated and thereby a successive flow for directing the cleaning medium to the one direction is generated. In such a method, the successive cleaning operations can be done in a limited area.

The twenty-fourth aspect of the invention is the method of cleaning the object to be cleaned, in which the magnetic field is an alternate magnetic field. In such the method, the direction of the magnetic field is successively turned over in order to facilitate stripping off the dirt. Thereby, the cleaning operation can be done effectively.

The twenty-fifth aspect of the invention in connection with one of the fifteenth through twenty-fourth is a method of cleaning the object to be cleaned wherein, after the cleaning operation, the magnetic field having an intensity to the extent that the dirt removed from the cleaned object by the operation of the cleaning is caused to float up on the upper surface of the cleaning medium. In such the method, since the dirt after cleaning can be easily removed, the cleaning medium can be repeatedly used. Thereby, the cleaning cost is reduced and the load for the environment can be also reduced.

The twenty-sixth in connection with one of the fifteenth through twentieth aspects is a method of cleaning the object to be cleaned, in which the magnetic field performs the cleaning operation by changing in order the magnetic field mode exerted on the same position of the cleaned object by use of the magnetic field generating device to the plural sorts of mode. In such the method, various sorts of force can be exerted on the magnetic substance and thereby the cleaning operation can be done effectively.

The twenty-seventh aspect of the invention in connection with one of the fifteenth through twenty-sixth is a method of cleaning the object to be cleaned, in which, when at least one of the intensity and the direction of the magnetic field generated for performing the cleaning operation is successively changed, a position excluding the position of the cleaned object cleaned with the cleaning medium is rubbingly cleaned by the rubbing material which moves by utilizing as the drive source the magnetic force applied to the magnetic pole generating the magnetic field. In such a method, the other area to be cleaned excluding the position cleaned by use of the cleaning medium can be jointly cleaned at the same time. Therefore, the cleaning operation can be done a short time.

The twenty-eighth aspect of the invention in connection with one of the fifteenth through twenty-sixth aspects is the method of cleaning the object to be cleaned, in which, after the cleaning operation, the cleaning the object is flushed, and the remaining dirt is removed after the cleaning operation. In such a method, the residual dirt remaining in the state of being stripped off from the cleaned object after cleaning is removed.

First Embodiment

An embodiment of the present invention is described hereinafter as the first embodiment.

FIG. 1 is a concept diagram illustrating the outline of the cleaning system 1 according to the first embodiment of the invention. The reference numeral 2 represents an object to be cleaned by the cleaning system 1. The cleaned object 2 is a toner cartridge, etc. of the copying machine and the laser printer. The toner cartridge is a molded one made of plastics. Otherwise, it may be desirable to construct the cleaned object 2 by use of the material capable of transmitting the magnetic flux. In the embodiment of the invention, regarding the area to be cleaned of the cleaned object 2, it is possible to guide the cleaning medium 3 into the interior of the container for the cleaned object 2. The cleaning medium 3 is the magnetic material 4, 4, . . . . The cleaned object 2 is disposed in the vicinity of a magnetic field generating device 5 for generating the magnetic field in the interior of the cleaned object 2 in the state that such the cleaning medium 3 has been guided in the interior of the cleaned object 2. In the embodiment, the cleaned object 2 is put on the magnetic field generating device 5. It may be allowable to use the one capable of electrically generating the magnetic field or the one capable of generating the magnetic field by use of using a permanent magnet.

In the cleaning system 1 of the structure as mentioned heretofore, the magnetic field 6 is generated by the magnetic field generating device 5, in the cleaning medium 3 in the interior of the cleaned object. The magnetic field applies a force to the magnetic material 4, 4, . . . . Thereby, the magnetic material 4, 4, . . . and the inner wall surface 7 on the area to be cleaned of the cleaned object 2 are rubbed with each other. As the result, the dirt attached to the inner wall surface 7 is peeled off, and the cleaned object is cleaned.

At this time, at least one of the direction and the strength of the magnetic field 6 generated in the interior of the cleaned object 2 is successively changed, and thereby the dirt becomes easily peeled off from the inner wall surface 7.

To state more concretely, as shown in FIG. 1, by changing the position of the magnetic pole 8, 8, . . . of the magnetic field generating device 5 by use of a movement device 9, at least one of the direction and the strength of the magnetic field 5 can be successively changed. In order to realize the above, it can be thought that the position of the magnetic pole 8, 8, . . . is vibrated with a constant period in a constant direction. Such the movement of the magnetic pole 8, 8, . . . can be realized by the movement device 9 of the well-known structure. Thereby, the magnetic field changing device is realized.

Figure 2:
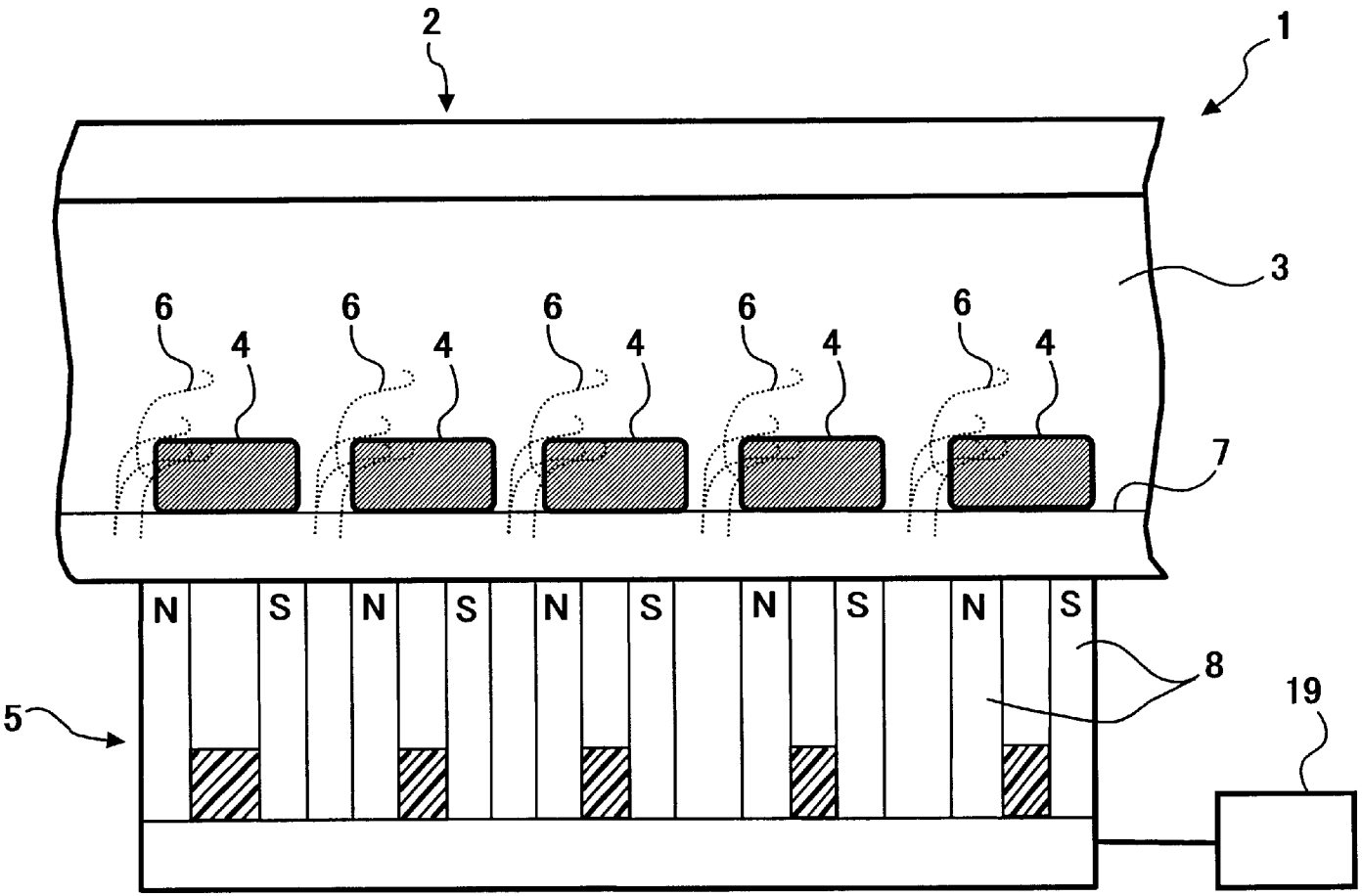
FIG. 2 is a concept diagram illustrating the above cleaning system.

Furthermore, as shown in FIG. 2, it may be allowable that the magnetic circuit in the magnetic field generating device 5 for electrically generating the magnetic field is controlled by use of the control device 19 constructed with the microcomputer, etc. so as to successively change at least one of the direction and the strength of the magnetic field generated by the magnetic field generating device 5. For instance, it can be thought that the strength of the magnetic field is strength of the magnetic field is strengthened or weakened with the constant period. Thereby, the magnetic field changing device can be realized.

Needless to mention, although the magnetic substance can be used as the cleaned object 2, the leakage magnetic flux has to be generated and the further strong magnetic field is required to be generated.

According to the cleaning system 1 as mentioned heretofore, although the cleaned object 2 has the position where the cleaned object 2 is cleaned structurally with the difficulty, the cleaned object can be easily rubbed and cleaned by use of the magnetic material 4, 4, By changing at least one of the strength and the direction of the magnetic field, the rubbingly cleaning operation can be effectively performed for the cleaned object 2.

Second Embodiment

Another embodiment of the present invention is described hereinafter as the second embodiment.

Figure 3:
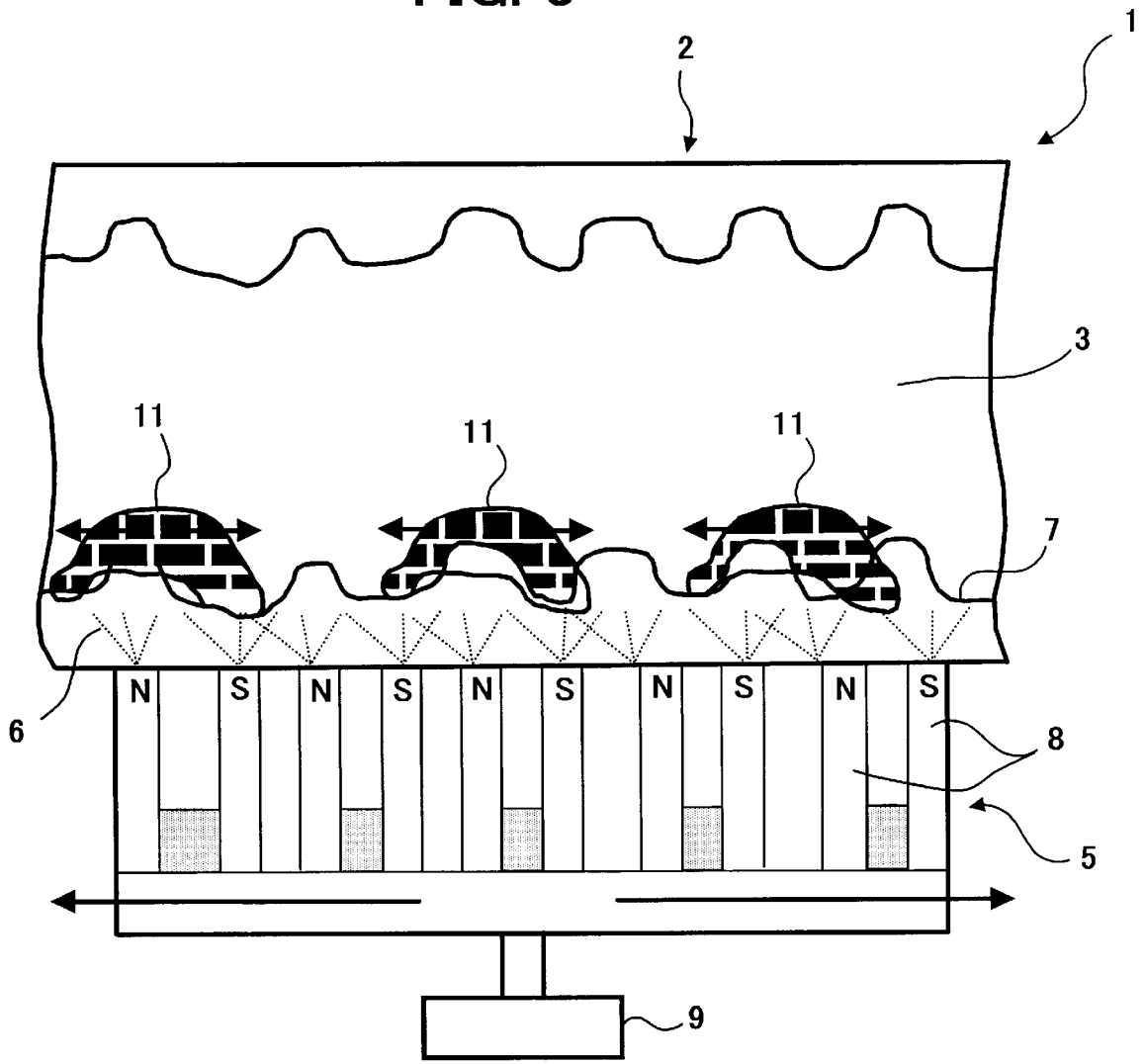
FIG. 3 is a concept diagram illustrating an outline of the cleaning system according to a second embodiment of the present invention.

FIG. 3 is a concept diagram illustrating the outline of the cleaning system 1 according to the second embodiment of the invention. In FIG. 3, the members attached with the same reference numerals in FIGS. 1 and 2 are the same ones as those of the first embodiment, and the detailed description thereof is omitted here.

In the case of the first embodiment, when the concave and convex portions are provided on the inner wall surface 7 of the area to be cleaned for the reason of functioning, only the convex portion of the inner wall surface thereof is rubbed with the magnetic material 4, 4, . . . . Since the concave portion thereof is not rubbed at all, the portion cannot be cleaned. On the other hand, in case that the magnetic substance 4, 4, . . . is the one like fine powder, even though the substance 4, 4, . . . is moved by the magnetic field generating device 5, since the powder-state substance cannot sufficiently enter into the fine gap space, there hardly occurs a rubbing function and thereby the cleaning operation cannot sufficiently performed.

Here, the second embodiment differs from the first embodiment in that a magnetic fluid 11 is employed as the magnetic material 4, 4, . . . as shown in FIG. 3.

Namely, the magnetic fluid 11 subs and cleans the inner wall surface 7 of the cleaned object 2 by the action of the magnetic field 5 generated by the magnetic field generating device 5. Since the magnetic fluid 11 can enter even the very fine gap space, the gap space can be effectively cleaned by the action of rubbingly.

Third Embodiment

Still another embodiment of the present invention is described hereinafter as the third embodiment.

Figure 4:
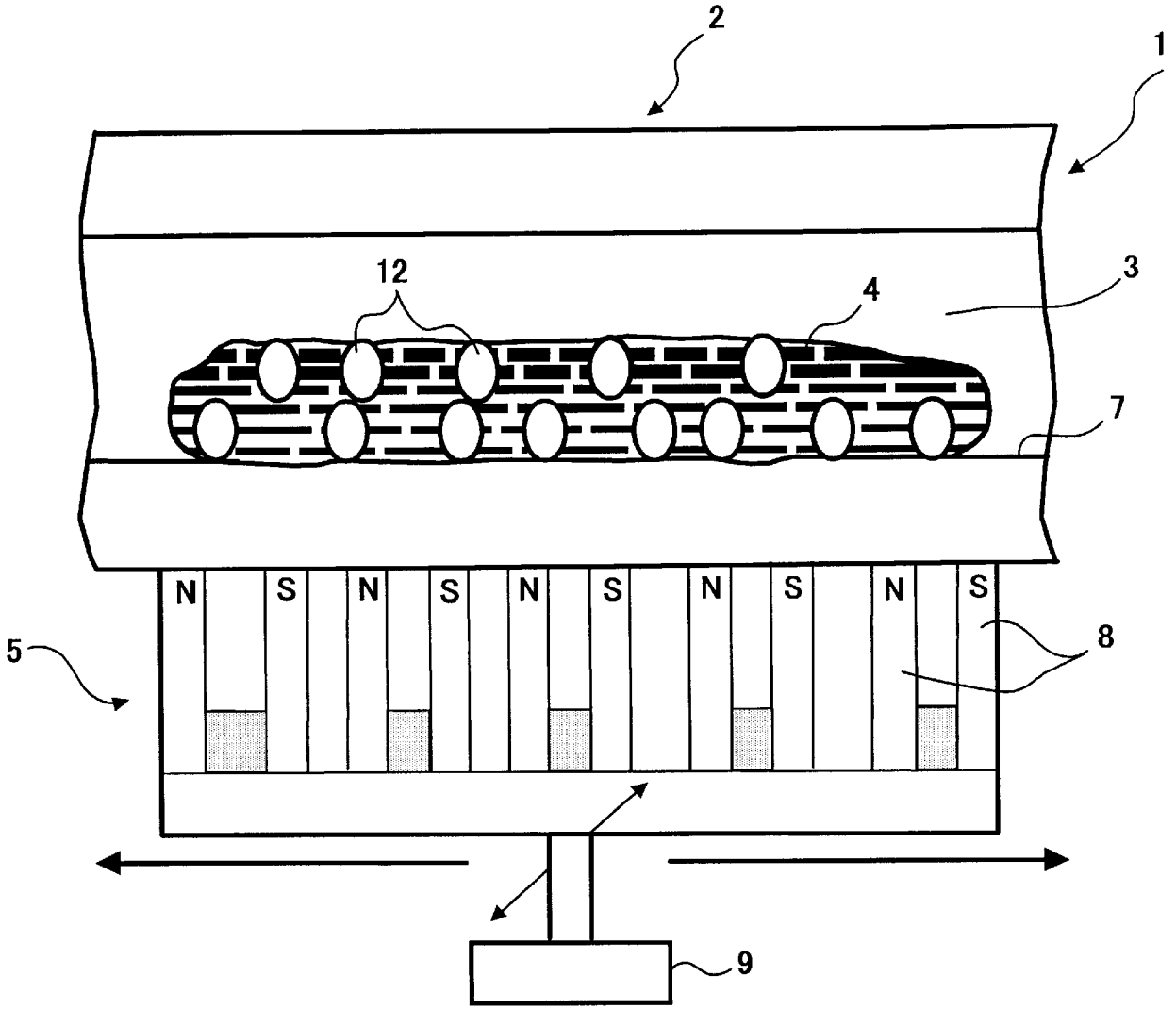
FIG. 4 is a concept diagram illustrating an outline of the cleaning system according to a third embodiment of the present invention.

FIG. 4 is a concept diagram illustrating the outline of the cleaning system 1 according to the third embodiment of the invention. In FIG. 4, the members attached with the same reference numerals in FIGS. 1 and 2 are the same ones as those of the first embodiment and the detailed description thereof is omitted here.

In the third embodiment of the invention, as shown in FIG. 3, a polishing agent 12, 12, . . . is contained in the cleaning medium 3 composed of the magnetic fluid 11, etc. The construction ratio of the cleaning medium 3 containing therein the polishing agent 12, 12, . . . is, for instance, almost 5/40 volume %. It may be allowable to adjust the construction ratio in accordance with the required content of cleaning such as the sort of the cleaned object, etc. As to the polishing agent 12, 12, __c__c, for instance, the media employed for the barrel polishing, etc. can be used. Otherwise, it can be thought to use plastic stone, massive stone, resinoid grinding (polishing) stone, walnut, corn, glass piece, and glass powder, etc.

In the third embodiment, since the cleaning operation is done by the action of the shearing stress due to the flowing of the fluid (magnetic fluid 11), although there is a case of insufficient force of peeling off the dirt in accordance with the usage, if the polishing agent 12, 12, . . . is contained in the cleaning medium 3, the polishing agent 12, 12, . . . reinforces the cleaning force of the magnetic material, and thereby the cleaning operation can be further effectively performed.

Furthermore, it is desirable to use the cleaning medium 3 containing therein the polishing agent 12, 12, . . . in the state of being well agitated. Either one of the non-magnetic material and the magnetic material can be used as the polishing agent 12. In the case of using the magnetic material, a magnetic force is applied to the magnetic material by the action of the magnetic field 6 generated by the magnetic field generating device 5. Thereby a force is also applied to the polishing material 12 from the magnetic material. As the result, the cleaning efficiency is further raised. On this occasion, either one of the liquid cleaning medium or the solid-state cleaning medium can be used as the cleaning medium.

Fourth Embodiment

Still another embodiment of the present invention is described hereinafter as the fourth embodiment.

Figure 5:
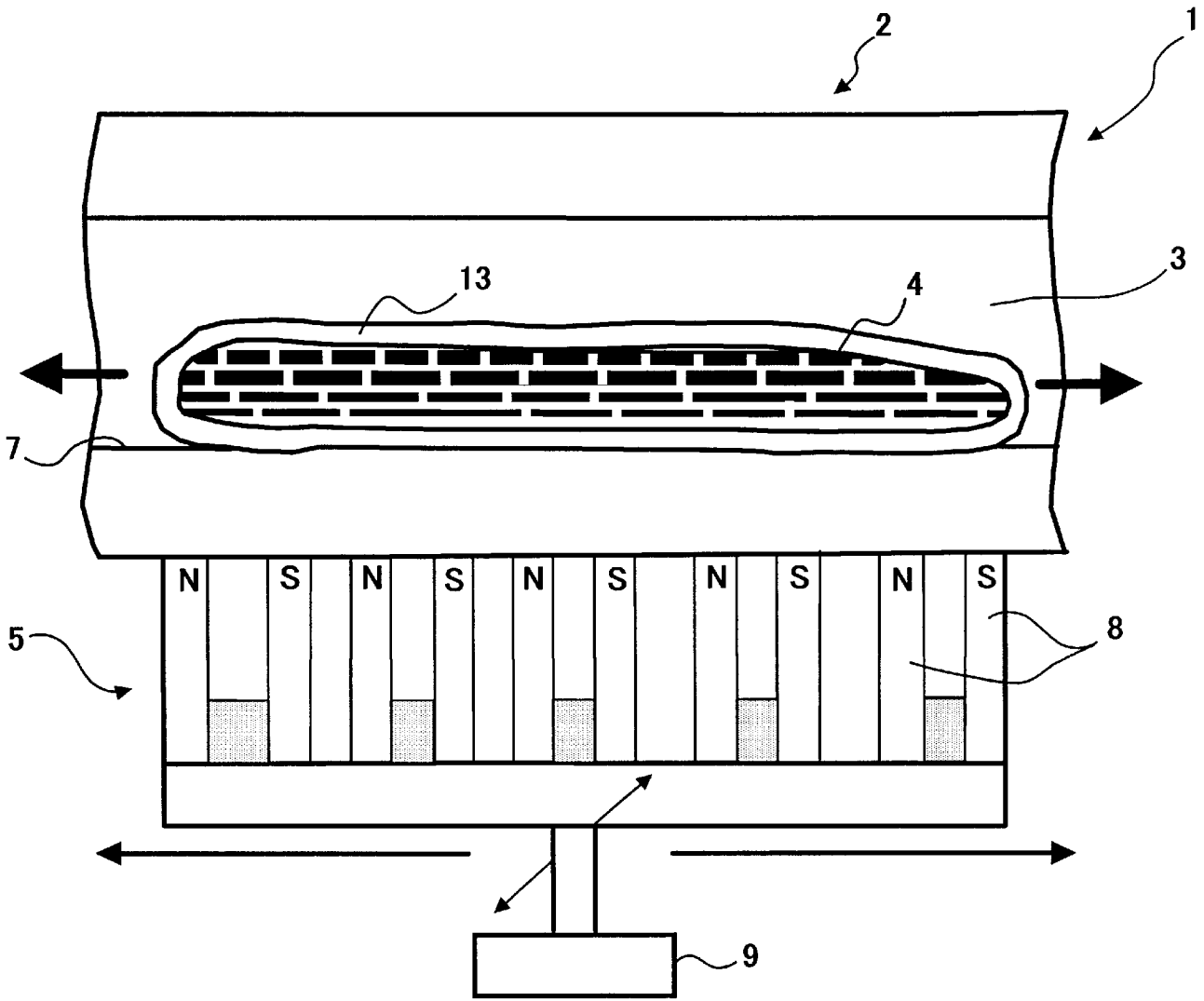
FIG. 5 is a concept diagram illustrating an outline of the cleaning system according to a fourth embodiment of the present invention.

FIG. 5 is a concept diagram illustrating the outline of the cleaning system 1 according to the fourth embodiment of the invention. In FIG. 5, the members attached with the same reference numerals in FIGS. 1 and 2 are the same ones as those of the first embodiment and the detailed description thereof is omitted here.

In the fourth embodiment of the invention, as shown in FIG. 5, the cleaning medium 3 constructed with the magnetic material 4 such as the magnetic fluid 11 is enclosed in an elastic covering material such as a soft covering film 13 and put in the state of shutting up the entire portion of the cleaning medium 3 in the covering film 13. The film 13 is constructed with the material, for instance, a thin rubber, a cloth not transmitting the fluid, or a diaphragm, etc. As shown in FIG. 5, when the magnetic field generating device 5 is moved, the inner wall surface 7 on the area to be cleaned of the cleaned object 2 is rubbed with the film 13, and thereby the cleaned object is cleaned. Furthermore, since the cleaning medium 3 is enclosed in the film 13, the cleaning medium 3 can be used again without being polluted by the dirt. Consequently, it is possible to reduce the cost required for performing the cleaning works.

Furthermore, when the magnetic fluid 11, etc. is put in the interior, even the cleaned object of comparatively complicated shape can be rubbingly cleaned following the shape of the inner wall surface 7 of the cleaned object 2. By changing the material, the composition, and the thickness of the covering film 13, or by changing, in various ways, the intensity and the direction of the magnetic field generated by the magnetic field generating devise 5, various variation can be applied to the cleaning effect.

Fifth Embodiment

Still another embodiment of the present invention is described hereinafter as the fifth embodiment.

Figure 6:
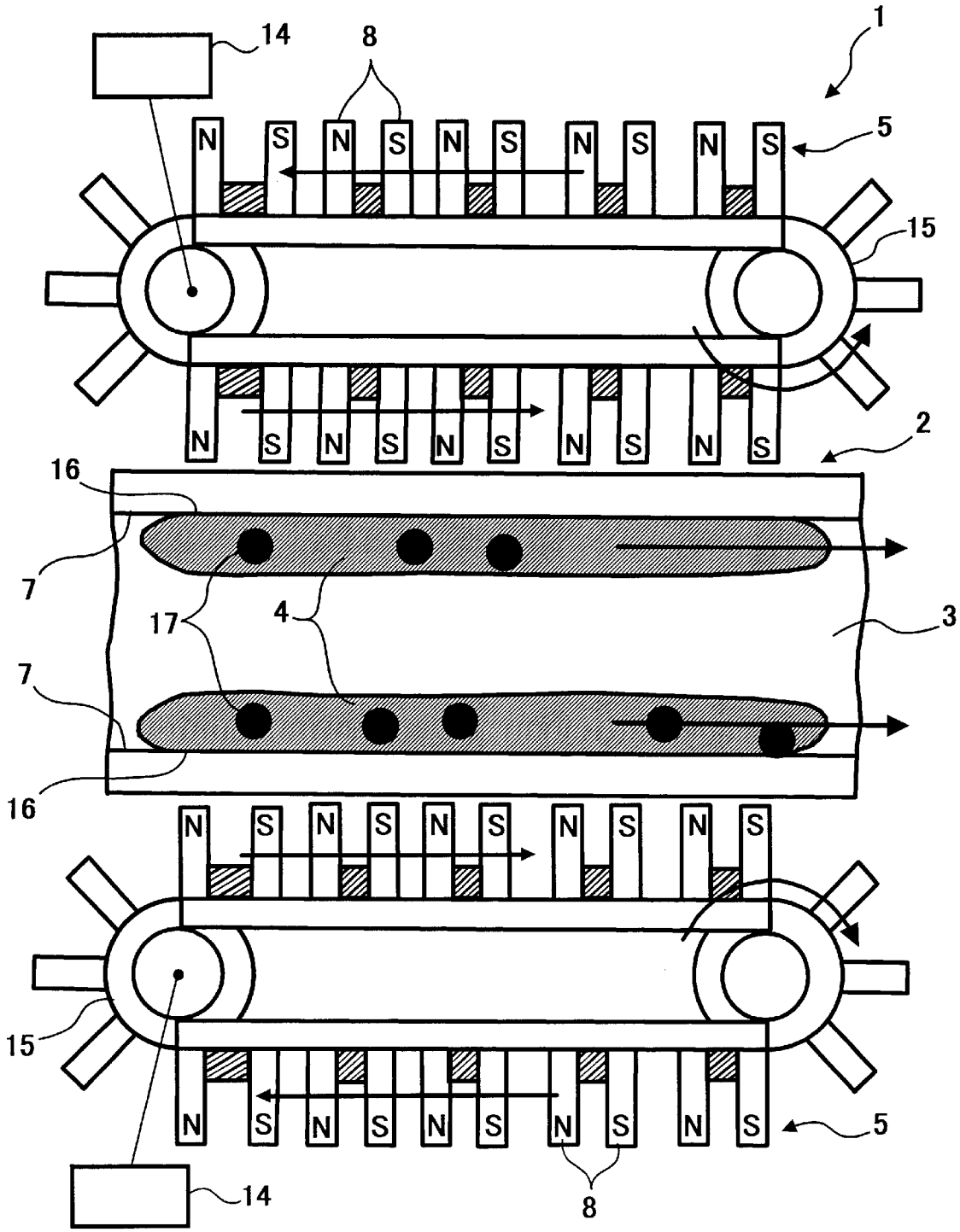
FIG. 6 is a concept diagram illustrating an outline of the cleaning system according to a fifth embodiment of the present invention.

FIG. 6 is a concept diagram illustrating the outline of the cleaning system 1 according to the fifth embodiment of the invention. In FIG. 6, the members attached with the same reference numerals in FIGS. 1 and 2 are the same ones as those of the first embodiment and the detailed description thereof is omitted here.

In the fifth embodiment of the invention, as shown in FIG. 6, the magnetic field generating device 5 is constructed on an infinite orbit 15 driven by a drive source 14 such as motor. For instance, the device 5 is constructed on and under the cleaned object 2. And then, following the movement of the infinite orbit 15, the magnetic field generating device 5 is constructed so as to move along the cleaned object 2. The magnetic field changing device can be realized by the movement of the infinite orbit 15. Thereby, the successive flowing of the cleaning medium 3 almost directed toward one direction side occurs along the inner wall surface 7 in the interior of the cleaned object 2. As the result, the successive shearing stress occurs in the wide area of the boundary surface 16 between the inner wall surface 7 of the cleaned object 2 and the cleaning medium 3. Thereby, the inner wall surface 7 thereof can be cleaned successively and the dirt 17 after cleaning can be carried away following the flow of the cleaning medium 3.

Sixth Embodiment

Still another embodiment of the present invention is described hereinafter as the sixth embodiment.

Figure 7:
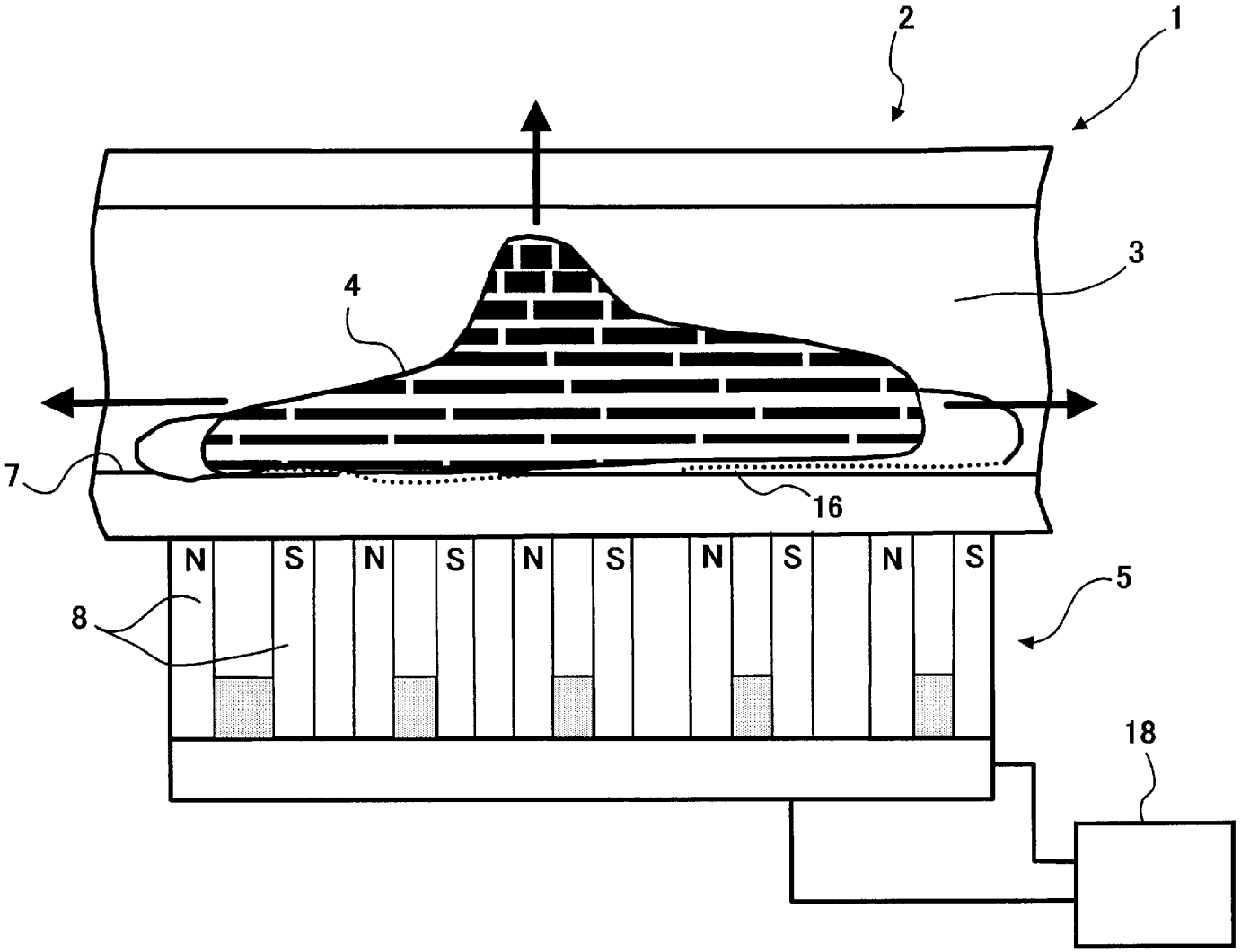
FIG. 7 is a concept diagram illustrating an outline of the cleaning system according to a sixth embodiment of the present invention.

FIG. 7 is a concept diagram illustrating the outline of the cleaning system 1 according to the sixth embodiment of the invention. In FIG. 7, the members attached with the same reference numerals in FIGS. 1 and 2 are the same ones as those of the first embodiment and the detailed description thereof is omitted here.

In the sixth embodiment of the invention, as shown in FIG. 7, a magnetic field generating device 5 generating the magnetic field from the electromagnet provided therein is applied with the alternate-current voltage by an electric power source 18. Thereby, the magnetic field generated from the magnetic field generating device 5 is converted to the alternate-current (AC) magnetic field. A magnetic field changing device can be realized by the above-mentioned operation. The frequency and the intensity (amplitude) can be adjusted at the side of the power source 18. The optimum one can be selected by the construction of the cleaning medium 3 guided into the interior of the cleaned object 2. The construction thereof is decided by whether the medium 3 is of liquid state or solid state. When the medium 3 is of liquid state, the construction is decided by the largeness of the viscosity. Thereby, the cleaning medium 3 causes the vibration in the interior of the cleaned object 2. Owing to the vibration, the shearing stress can be generated on the boundary surface 16 between the inner wall surface 7 and the cleaning medium 3. Consequently, the cleaning ability can be improved.

Seventh Embodiment

Still another embodiment of the present invention is described hereinafter as the seventh embodiment.

Figure 8:
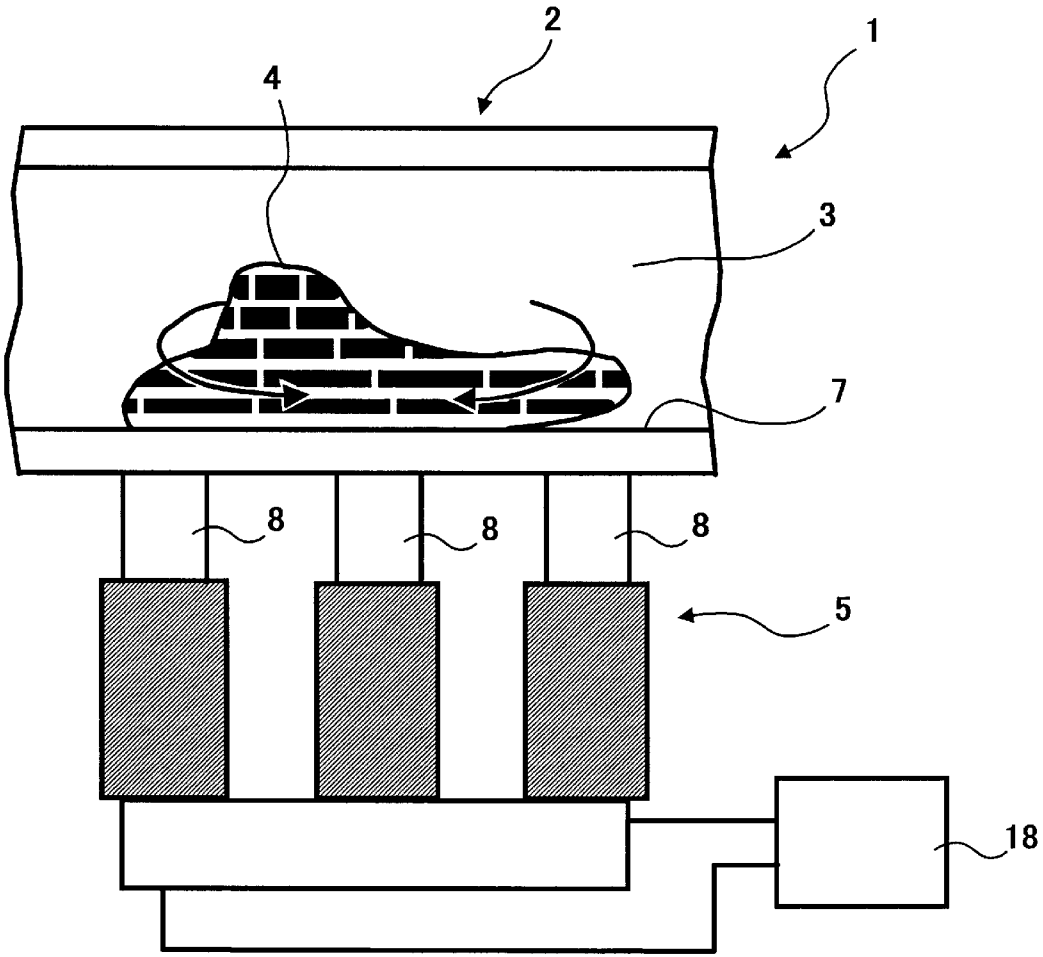
FIG. 8 is a concept diagram illustrating an outline of the cleaning system according to a seventh embodiment of the present invention.

FIG. 8 is a concept diagram illustrating the outline of the cleaning system 1 according to the seventh embodiment of the invention. In FIG. 8, the members attached with the same reference numerals in FIGS. 1 and 2 are the same ones as those of the first embodiment and the detailed description thereof is omitted here.

In the seventh embodiment of the invention, as shown in FIG. 8, the magnetic field generating device 5 is provided with magnetic poles 8, 8, 8, respectively composed of electromagnet arranged on the position corresponding to the respective corners of a regular (equilateral) triangle. The power source 18 respectively supplies three-phases AC current to the coils of the respective magnetic poles 8, 8, 8 and thereby generates the rotary magnetic field thereon. A magnetic field changing device can be realized by the generation of the above rotary magnetic field. In such the rotary magnetic field, the position of appearing magnetic pole changes with the time elapsing and the position thereof seemingly rotates. By the action of the rotary magnetic field exerted on the magnetic material 4, the cleaning medium 3 flows so as to rotate along the inner wall surface 7 of the cleaned object 2. Owing to the successive rotational flowing of the cleaning medium 3, the entire inner wall surface 7 of the cleaned object 2 can be cleaned. Furthermore, by changing the switching of the electricity conduction to the respective coils performed by the power source 10, the rotational direction of the rotary magnetic field is periodically turned over. Consequently, the effect of cleaning can be enhanced further effectively.

Eighth Embodiment

Still another embodiment of the present invention is described hereinafter as the eighth embodiment.

Figure 9:
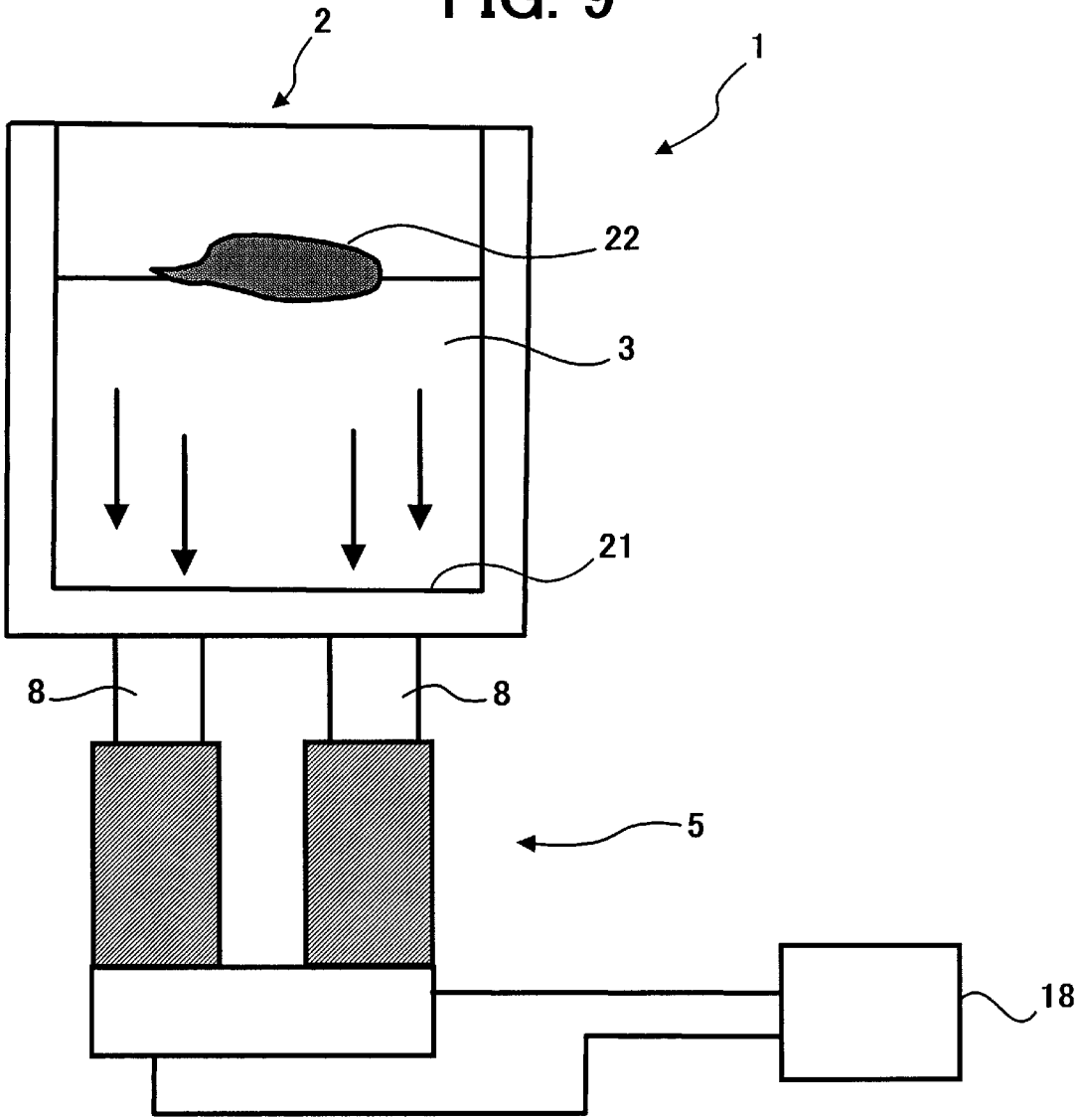
FIG. 9 is a concept diagram illustrating an outline of the cleaning system according to an eighth embodiment of the present invention.

FIG. 9 is a concept diagram illustrating the outline of the cleaning system 1 according to the eighth embodiment of the invention. In FIG. 9, the members attached with the same reference numerals in FIGS. 1 and 2 are the same ones as those of the first embodiment and the detailed description thereof is omitted here.

In the eighth embodiment of the invention, as shown in FIG. 9, the power source 18 supplies the electric current to the coils of the magnetic poles 8, 8 composed of the electromagnet and thereby generates the magnetic field. Consequently, the interior of the cleaned object 2 can be cleaned with the cleaning medium 3 composed of the magnetic fluid 11, etc. And then, after cleaning the interior of the cleaned object 2, the power source 18 applies the magnetic field of a predetermined intensity (amplitude) further stronger than that of the magnetic field applied at the time of cleaning to the cleaning medium 3 from the magnetic poles 8, 8 contained in the power source 18. As the result, the cleaning medium 3 is pushed with a strong force to the inner wall 21 of the cleaned object 2. Seemingly, the force acts thereon so as to raise the specific gravity of the magnetic fluid 11. Seemingly, the specific gravity of the dirt 22 after cleaning taken in the interior of the magnetic fluid 11 relatively becomes reduced, and the dirt is floating onto the upper surface portion of the cleaning medium 3. Thereby, the dirt removing device can be realized. By scooping up the floating-up dirt 22, the magnetic fluid 11 can be kept in the cleaned state.

Consequently, by repeating the cleaning operation, the pollution of the magnetic fluid 11 due to the dirt 22 can be prevented from advancing.

Ninth Embodiment

Still another embodiment of the present invention is described hereinafter as the ninth embodiment.

Figure 10:
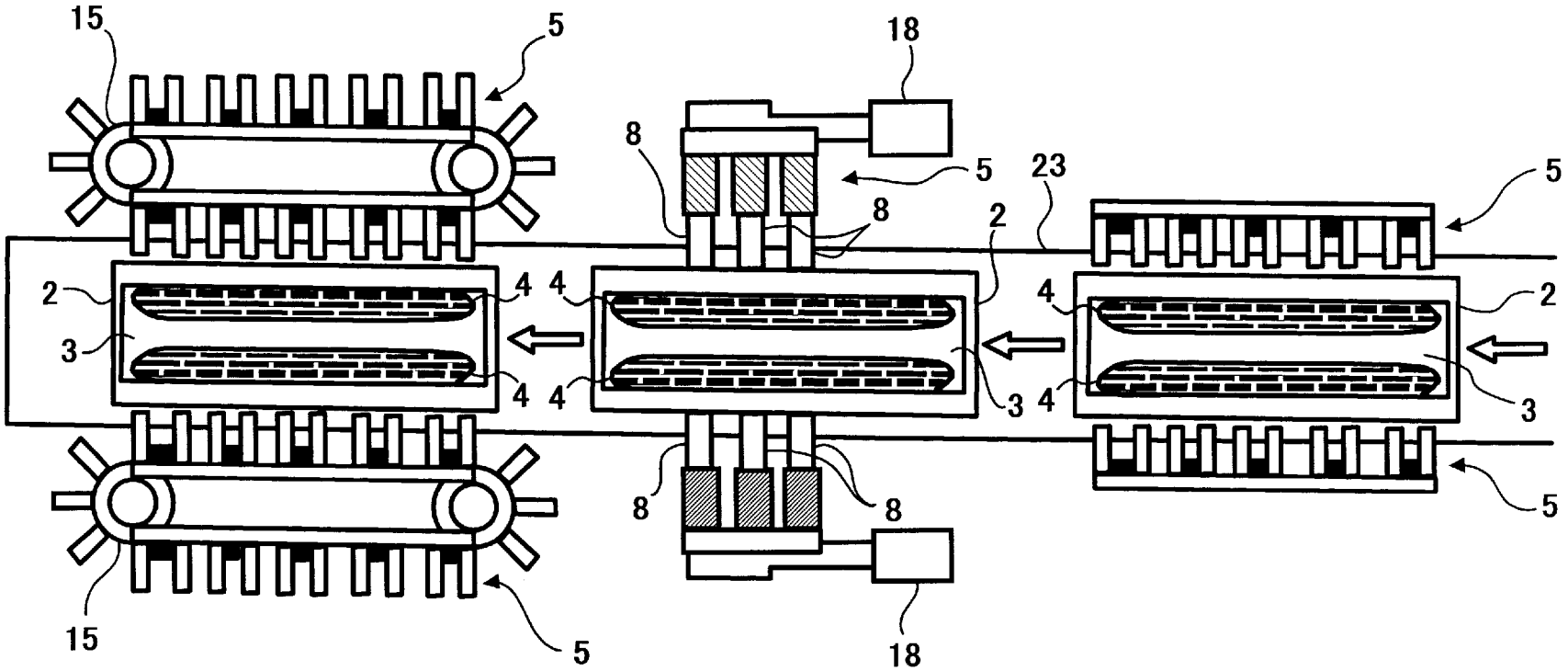
FIG. 10 is a concept diagram illustrating an outline of the cleaning system according to a ninth embodiment of the present invention.

FIG. 10 is a concept diagram illustrating the outline of the cleaning system 1 according to the ninth embodiment of the invention. In FIG. 10, the members attached with the same reference numerals in FIGS. 1 and 2 are the same ones as those of the first embodiment and the detailed description thereof is omitted here.

In the ninth embodiment of the invention, as shown in FIG. 10, the cleaned object 2 having the cleaning medium 3 previously guided in the interior thereof is carried on the conveyor 23 and moved. Plural sorts (three sorts, in FIG. 10) of the magnetic field generating devices 5, 5, 5 are arranged along the conveying direction of the conveyor 23 on the respective positions at the side portion of the conveyor 23. The magnetic field generating devices 5, 5, 5 are respectively of different sorts. For instance, in the example of FIG. 10, there are arranged the magnetic field generating device 5 for generating the AC magnetic field of the sixth embodiment, the magnetic field generating device 5 for generating the AC magnetic field of the eighth embodiment, and the magnetic field generating device 5 for making the successive flow of the cleaning medium 3 to one direction of the fifth embodiment, in the order from the upstream side.

In the cleaning system 1, the conveyor 23 conveys the cleaned object 2 and the magnetic field of the different states (direction, magnitude, and the other various sorts of variation, etc.) is exerted on the cleaning medium 3 in order. Thereby, the cleaning medium 3 can perform the action on the cleaned object 2 with various states. Consequently, the cleaning operation can be effectively done and thereby the magnetic field state changing device can be realized.

Moreover, it may be allowable that the different states of the magnetic fields are exerted in order on the cleaned object 3 by changing, in order, the control state by use of the microcomputer or the pattern of the mechanical movement by use of the movement device 9 only employing one sort of magnetic field generating device 5 without preparing plural sorts of the magnetic field generating device 5.

Tenth Embodiment

Still another embodiment of the present invention is described hereinafter as the tenth embodiment.

Figure 11:
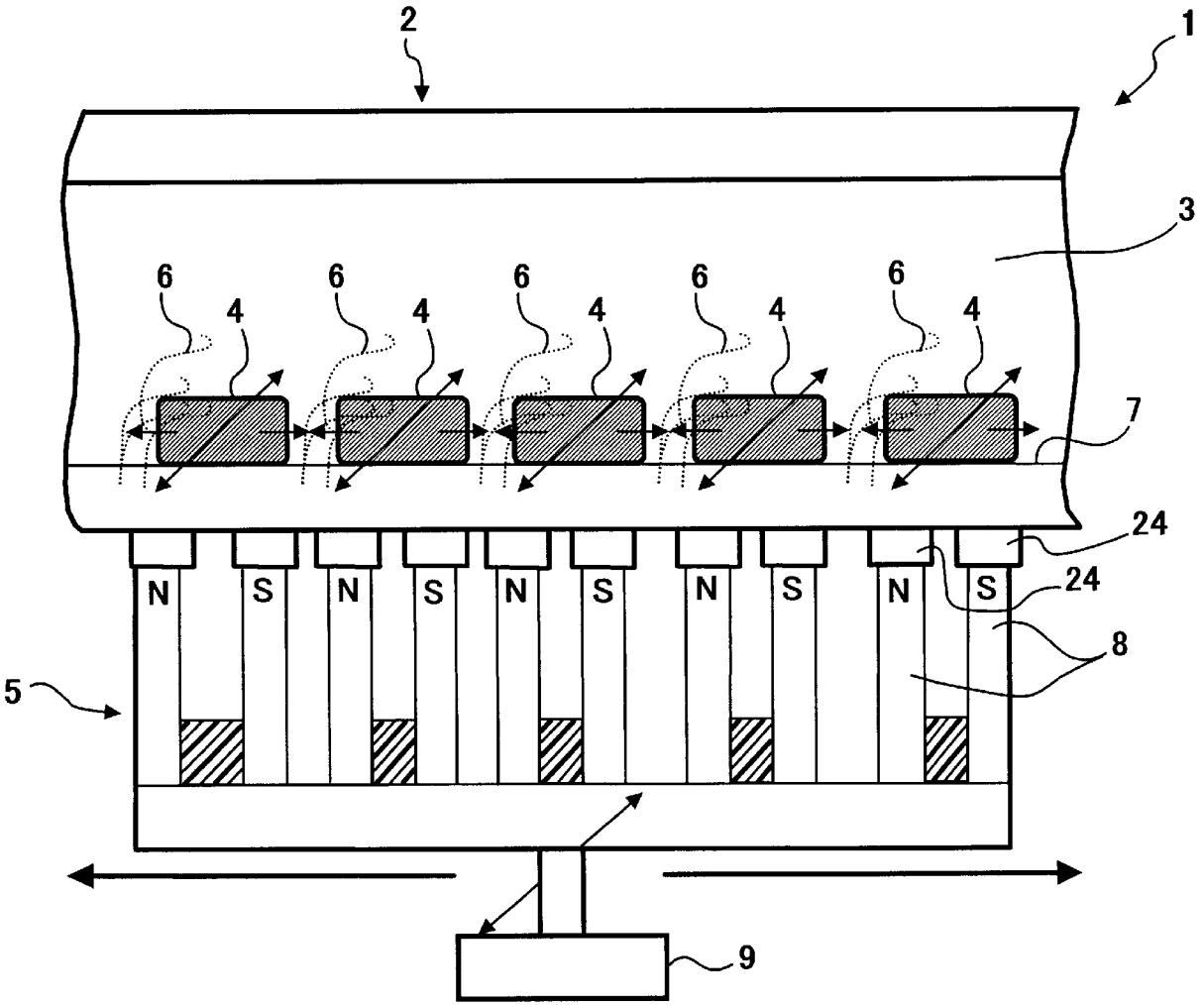
FIG. 11 is a concept diagram illustrating an outline of the cleaning system according to a tenth embodiment of the present invention.

FIG. 11 is a concept diagram illustrating the outline of the cleaning system 1 according to the tenth embodiment of the invention. In FIG. 11, the members attached with the same reference numerals in FIGS. 1 and 2 are the same ones as those of the first embodiment and the detailed description thereof is omitted here.

In the tenth embodiment of the invention, as shown in FIG. 11, the rubbing materials 24, 24, such as felt material, sponge, etc. generally used for cleaning are formed on the tip end of the magnetic poles 8, 8, . . . constructed for forming the leakage magnetic field in the magnetic field generating device 5. The magnetic field generating device 5 is moved by the movement device 9. When at least one of the magnitude (intensity) and the direction of the magnetic field is successively changed, the rubbing materials 24, 24, . . . are moved by the force exerted on the magnetic poles 8, 8, . . . as the drive source. At the time of cleaning the interior of the cleaned object 2, the other positions excluding the area to be cleaned by the cleaning medium 3 such as the outer circumferential surface of the cleaned object 2 are also rubbed and cleaned with the rubbing materials 24, 24, . . . . Needless to mention, on this occasion, it may be allowable to use either one of a general permanent magnet and an electromagnet in the magnetic field generating device 5. Furthermore, even in case that the magnetic poles 8, 8, . . . is employed as the electromagnet and at least one of the intensity and the direction of the magnetic field is successively changed under the control of the control device 19, the magnetic force is applied to the magnetic poles 8, 8, . . . and thereby the vibration occurs thereon on some occasions. Even at this time, it may be allowable that the rubbing materials 24, 24, . . . are moved by the force exerted on the magnetic poles 8, 8, . . . as the drive force.

Eleventh Embodiment

Still another embodiment of the present invention is described hereinafter as the eleventh embodiment.

The members attached with the same reference numerals in FIGS. 1 and 2 are the same ones as those of the first embodiment and the detailed description thereof is omitted here.

In the eleventh embodiment of the invention, although it is not shown in figures, after completing the cleaning operation by use of either one of the devices according to the first through tenth embodiments, the state of the rubbed-off dirt is changed from the state of sticking to the cleaned object 2 to the other state of floating therefrom. Thereafter, when the cleaning medium 3 is withdrawn, almost all of the dirt can be removed together with the cleaning medium. However, in the eleventh embodiment, the cleaned object is flushed by the compressed air or the jet-water stream, etc. by use of the device of the well-known structure, and the dirt can be blown off (away) and the amount of the residual dirt remaining in the cleaned object 2 can be reduced. Thereby, the flushing device can be realized.

Twelfth Embodiment

Still another embodiment of the present invention is described hereinafter as the twelfth embodiment.

Figure 12:
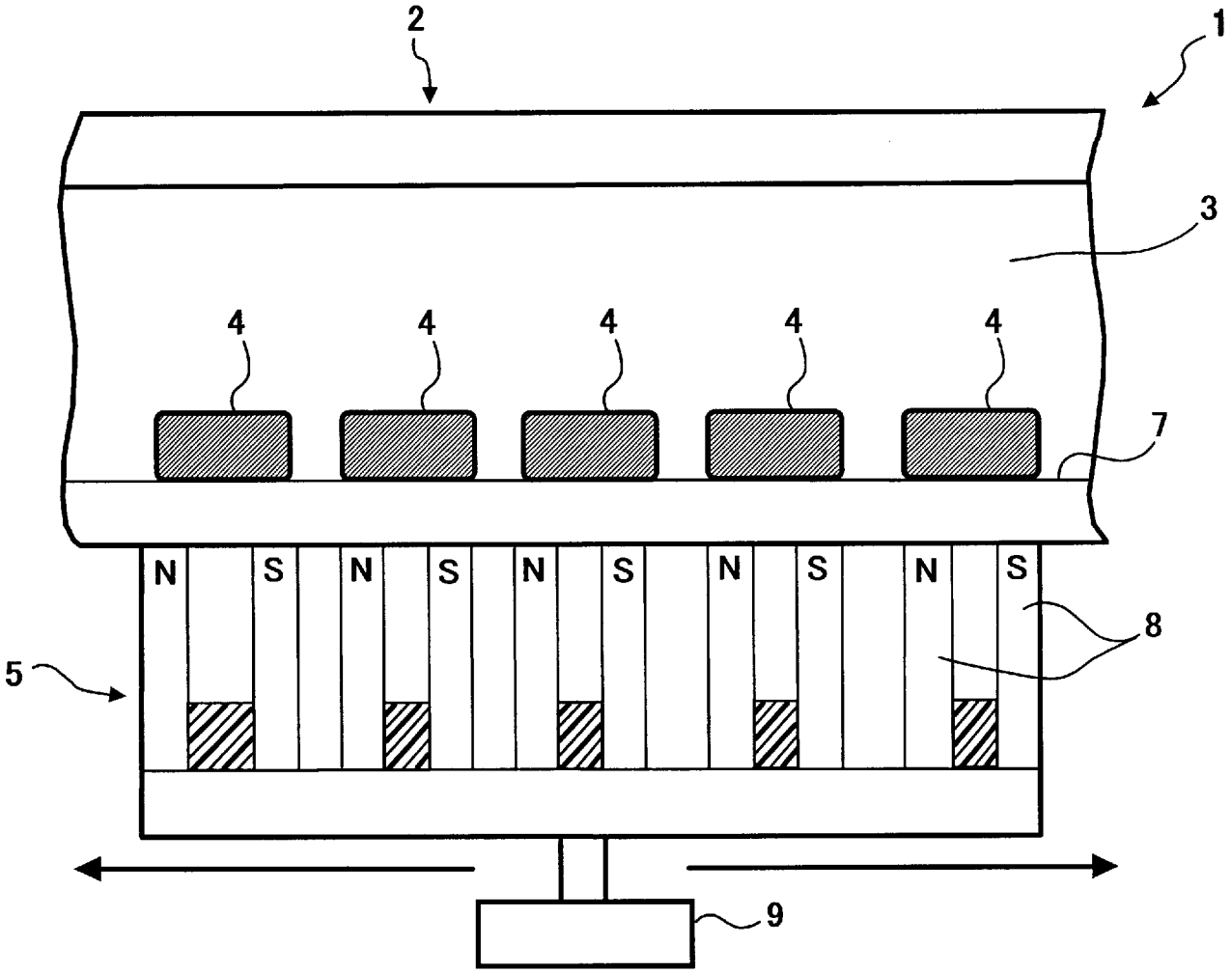
FIG. 12 is a concept diagram illustrating an outline of the cleaning system according to a twelfth embodiment of the present invention.

FIG. 12 is a concept diagram illustrating the outline of the cleaning system 1 according to the twelfth embodiment of the invention. In FIG. 12, the members attached with the same reference numerals in FIGS. 1 and 2 are the same ones as those of the first embodiment and the detailed description thereof is omitted here.

In the twelfth embodiment of the invention, as shown in FIG. 12, the powder shape of the magnetic materials 4, 4, . . . is polygonal (polyhedron). In the example of FIG. 12, the powder shape thereof is hexagonal (hexahedron). Compared with the shape of the sphere, since such the powder of polyhedron very hardly rotates, the powder moves on the inner wall surface 7 of the cleaned object 2 moves without rolling over. Consequently, the rubbing function (efficiency) on the inner wall surface 7 becomes enlarged and thereby the effect of cleaning can be raised.

Thirteenth Embodiment

Still another embodiment of the present invention is described hereinafter as the thirteenth embodiment.

Figure 13:
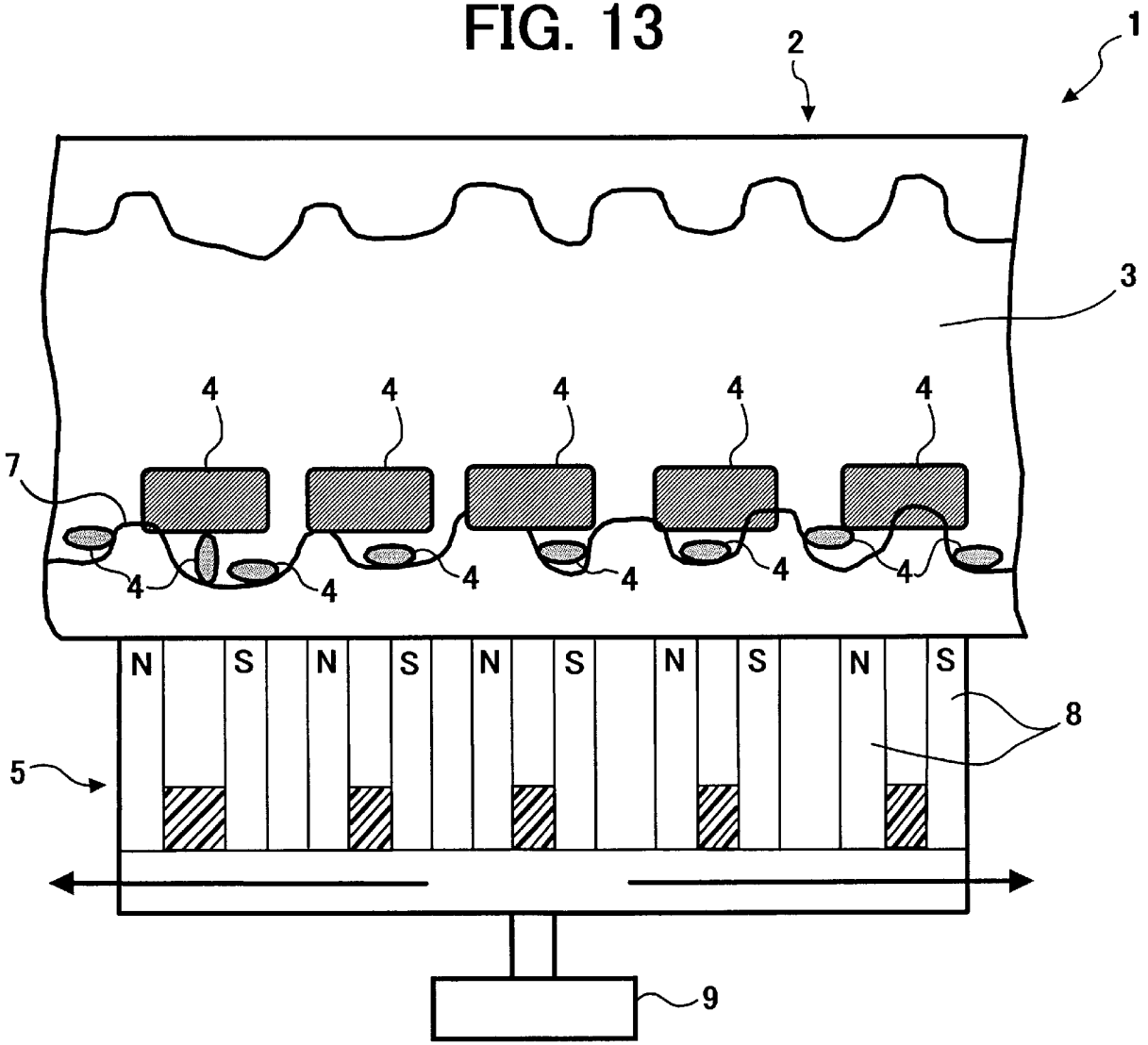
FIG. 13 is a concept diagram illustrating an outline of the cleaning system according to a thirteenth embodiment of the present invention.

FIG. 13 is a concept diagram illustrating the outline of the cleaning system 1 according to the thirteenth embodiment of the invention. In FIG. 13, the members attached with the same reference numerals in FIGS. 1 and 2 are the same ones as those of the first embodiment and the detailed description thereof is omitted here.

In the thirteenth embodiment of the invention, as shown in FIG. 13, since all sizes of the cleaning media 3 are not equal to each other, and the powder sizes of the magnetic materials 4, 4, . . . and the polishing materials 12, 12, . . . are intentionally determined at random, the small-sized powder can enter the narrow spaces on the cleaning position respectively having the concave and convex portions, and even the narrow positions can be cleaned sufficiently. On this occasion, there are at least two sorts of particle sizes. In the case of employing the magnetic material 4 and the polishing material 12, there exist at least one sort of the magnet material 4 and at least another sort of the polishing material 12.

As is apparent from the foregoing description, many advantageous functional effects can be expected in the respective aspects of the present invention. In the first aspect, the interior of the cleaned object to which the hand of the operator or the instrument hardly approaches can be easily cleaned by use of the simple device. In the second aspect, even though the concave and convex portions exist on the area to be cleaned, the cleaned object can be easily cleaned with the shearing stress due to the flowing of the magnetic fluid and the adjustment of the cleaning force can be easily done with the strength of the magnetic field. In the third aspect, the area to be cleaned is further strongly rubbed with the polishing agent, and thereby the cleaning operation can be done effectively. Furthermore, by changing the compound ratio of the polishing agent, the freedom of adjusting the cleaning property can be increased. In the fourth aspect, since the magnetic material as the cleaning medium is not polluted by the cleaning operation, the material can be repeatedly used and thereby the cost of the cleaning works can be reduced.

In the fifth and sixth aspects, since the particle shape of at least a part of the magnetic substance is polygonal, the rubbingly-cleaning can be effectively done compared with the case of the particle shape without any corner just like the spherical shape. The comparatively small particle can clean the object, entering in the narrow concave and convex areas, thereby the cleaning can be effectively done.

In the seventh through twelfth aspects, by successively changing the intensity and the direction of the magnetic field, the dirt can be easily peeled off, and thereby the cleaning operation can be easily done. The successive cleaning operation can be done in the wide area or in the limited area, and the dirt after cleaning is carried away and the residual dirt does not remain on the cleaned object. By successively turning over the direction of the magnetic field, the dirt can be easily peeled off, and thereby the cleaning operation can be done effectively. Furthermore, since the dirt after cleaning can be easily removed, the cleaning medium can be repeatedly used. Consequently, the cleaning cost can be reduced and the load in the environment can be also reduced. Furthermore, the force of various aspects can be exerted on the magnetic material, and thereby the cleaning operation can be done effectively.

In the thirteenth and fourteenth aspects, the other position than that of cleaning the object by use of the cleaning medium can be also cleaned for a short time. The residual dirt peeled off from the cleaned object after cleaning can be removed effectively.

In the fifteen aspect, a method of cleaning the object to be cleaned by use of a cleaning system comprises the steps of: generating a magnet field in a cleaning medium, applying a magnetic force to the magnetic substance, and rubbing each other the magnetic substance and the area to be cleaned. Even the interior of the cleaned object to which the hand of the operator or the instrument hardly approaches can be easily cleaned with the simple device.

In the sixteen through twenty-eighth aspects, even though there exist the concave and convex portions, the cleaning operation can be easily done with the shearing stress due to the flow of the magnetic fluid. The cleaning force can be easily adjusted with the strength of magnetic forth due to the magnetic field. The area to be cleaned is further strongly rubbed with the polishing agent and thereby the cleaning operation can be done effectively. By changing the composition ratio of the polishing agent, the freedom of adjusting the cleaning property may become large. Since the magnetic material as the cleaning medium is not polluted by the cleaning operation, the material can be repeatedly used and thereby the cost of the cleaning works can be reduced. Other advantageous functional effects as mentioned in the second through fourteenth aspects can be also expected in the sixteenth through twenty-eighth aspects.

The preferred embodiments of the present invention (the first through thirteenth embodiments; the first through twenty-eighth aspects of the invention) have been described heretofore. However, numerous additional modifications and variations of the present invention are possible in light of the above teachings. It is therefore to be understood that, within the scope of the appended claims the present invention may be practiced otherwise than as specifically described herein.

What is claimed as new and is desired to be secured by Letters Patent of the United States:

1. A method of cleaning an object to be cleaned by use of a cleaning system comprising the steps of:

generating a magnetic field in a cleaning medium having a part thereof composed of magnetic substance and guided onto the area to be cleaned of the object;

applying a magnetic force to said magnetic substance by the action of said generated magnetic field; and rubbing against each other said magnetic substance and said area to be cleaned in order to clean said area to be cleaned with said cleaning medium, wherein said area to be cleaned is located in an interior of the object.

2. The method of cleaning the object to be cleaned as defined in claim 1, wherein at least a part of said magnetic substance is a magnetic fluid.

3. The method of cleaning the object to be cleaned as defined in claim 1, wherein a polishing agent is contained in said cleaning medium in order to further effectively clean said cleaning position by the action of said magnetic force from said magnetic substance is employed.

4. The method of cleaning the object to be cleaned as defined in claim 1, wherein said magnetic substance enclosed in an elastic covering material is employed.

5. The method of cleaning the object to be cleaned as defined in claim 1, wherein the particle shape of at least a part of said magnetic substance is polygonal.

6. The method of cleaning the object to be cleaned as defined in claim 1, wherein the respective particle sizes of said magnetic substance and said polishing agent are different.

7. The method of cleaning the object to be cleaned as defined in one of claims 1 through 6, wherein said cleaning operation is performed by successively changing at least either one of the strength and the direction of said magnetic field.

8. The method of cleansing the object to be cleaned as defined in claim 7, wherein a successive flow of said cleaning medium to be directed in one direction is generated by successively changing at least one of said strength and direction of said magnetic field.

9. The method of cleaning the object to be cleaned as defined in claim 8, wherein a rotative magnetic field is generated.

10. The method of cleaning the object to be cleaned as defined in claim 7, wherein said magnetic field is an alternate magnetic field.

11. The method of cleaning the object to be cleaned as defined in claim 1, wherein, after said cleaning operation, the magnetic field is generated having the intensity to the extent that the dirt stripped from said cleaned object by the operation of said cleaning is caused to float up on the upper surface of said cleaning medium.

12. The method of cleaning the object to be cleaned as defined in claim 1, wherein said magnetic field performs said cleaning operation by changing successively said magnetic field mode exerted on the same position of said cleaned object by use of said magnetic field generating device.

13. The method of cleaning the object to be cleaned as defined in claim 1, wherein, when at least one of the strength and the direction of said magnetic field generated for performing said cleaning operation is successively changed, the position excluding the position of said cleaned object cleaned with said cleaning medium is abrasively cleaned by said abrasive material which moves by utilizing as the drive source the magnetic force applied to the magnetic pole generating the magnetic field.

14. The method of cleaning the object to be cleaned as defined in claim 1, wherein, after said cleaning operation, said cleaned object is flushed, and the remaining dirt is removed even after said cleaning operation.

* * * * *